343-700 MS AU 251 EX
12/15/87 OR 4,713,670

United States Patent [19]

Makimoto et al.

[11] Patent Number: 4,713,670

[45] Date of Patent: Dec. 15, 1987

[54] PLANAR MICROWAVE ANTENNA HAVING HIGH ANTENNA GAIN

[75] Inventors: Toshio Makimoto, 15-3, Shinsenri Nishi-machi 2-chome, Toyonaka-shi, Osaka 565; Sadahiko Nishimura, 3-25, Tamatsukuri Motomachi, Tennoji-ku, Osaka 543; Masayuki Matsuo, Kobe; Toshio Abiko, Ibaraki; Hirohumi Ishizaki, Osaka; Minoru Kanda, Shijonawate; Hidetsugu Nunoya; Mikio Komatsu, both of Kadoma, all of Japan

[73] Assignees: Toshio Makimoto; Sadahiko Nishimura; Matsushita Electric Works, Ltd., all of Osaka, Japan

[21] Appl. No.: 819,610

[22] Filed: Jan. 17, 1986

[30] Foreign Application Priority Data

Jan. 21, 1985 [JP] Japan ..... 60-8771

[51] Int. Cl.[4] ..... H01Q 1/38

[52] U.S. Cl. ..... 343/700 MS; 343/864

[58] Field of Search ..... 343/700 MS, 829, 731, 343/846, 737, 725, 729, 864, 893

[56] References Cited

U.S. PATENT DOCUMENTS

| | | | |
|---|---|---|---|
| 4,079,268 | 3/1978 | Fletcher et al. | 343/700 MS |
| 4,203,116 | 5/1980 | Lewin | 343/700 MS |
| 4,238,798 | 12/1980 | Aitken et al. | 343/700 MS |
| 4,398,199 | 8/1983 | Makimoto et al. | 343/700 MS |
| 4,475,107 | 10/1984 | Makimoto et al. | 343/700 MS |

*Primary Examiner*—William L. Sikes
*Assistant Examiner*—Michael C. Wimer
*Attorney, Agent, or Firm*—Burns, Doane, Swecker & Mathis

[57] ABSTRACT

A microwave plane antenna comprises a plurality of pairs of antenna elements connected at their one end to a power supply circuit and respectively including at the other terminating end an impedance-matched patch antenna means, whereby signal energy remaining at the terminating ends of the antenna elements is caused to be effectively utilized as radiation energy, and any power loss is restrained for a high antenna gain and improved aperture efficiency.

6 Claims, 4 Drawing Figures

PLANAR MICROWAVE ANTENNA HAVING HIGH ANTENNA GAIN

TECHNICAL BACKGROUND OF THE INVENTION

This invention relates to microwave plane antennas.

The microwave plane antenna of the type referred to is effective to receive circularly polarized waves or the like which are transmitted as carried on SHF band, in particular, 12 GHz band, from a geostationary broadcasting satellite launched into cosmic space to be 36,000 Km high from the earth.

DISCLOSURE OF PRIOR ART

Antennas generally used by listeners for receiving such circularly polarized waves sent from the geostationary broadcasting satellite are parabolic antennas erected on the roof or the like position of house buildings. However, the parabolic antenna has been involving such problems that it is susceptible to strong wind to easily fall due to its bulky structure so that an additional means for stably supporting the antenna will be necessary, and the supporting means further requires such troublesome work as a fixing to the antenna of reinforcing pole members forming a major part of the supporting means, which work may happen to result even in a higher cost than that of the antenna itself.

In attempt to eliminate these problems of the parabolic antenna, there has been suggested in Japanese Patent Appln. Laid-Open Publication No. 57-99803 (corresponding to U.S. Pat. No. 4,475,107 or to German Offenlegungsschrift No. 314900.2) a plane antenna which is flattened in the entire configuration and comprises a plurality of cranked microstrip lines arranged in pairs on the upper surface of an antenna body of an insulating substrate of a Teflon glass fiber, polyethylene or the like, and an earthing conductor provided over the entire lower surface of the antenna body. The pairs of the microstrip lines are connected respectively at one end with each of branched strip line conductors of a power supply circuit in a tournament connection so that a travelling wave current can be supplied parallelly to the respective paired microstrip lines at the same amplitude and phase.

In such plane antenna, the travelling wave current is utilized to achieve a favourable antenna gain, and thus it is necessary to restrain any reflection of signal energy at the terminating ends of the respective pairs of microstrip lines. For this purpose, the paired microstrip lines have been provided at the terminating ends respectively with such a termination resistor as a chip resistor. The termination resistors function to absorb signal energy remaining at the respective terminating ends of the respective paired microstrip lines and any undesirable radiation phenomenon due to reflected signal energy can be prevented from occurring.

The foregoing plane antenna can be made simpler in the structure and inexpensive, and is still capable of remarkably reducing the required cost for the fixing work because the antenna can be mounted directly on an outdoor wall of house buildings without requiring any additional supporting means. However, this plane antenna has been defective in that, though the reflection of the signal energy may be prevented, the signal energy is to be consumed at the resistors as Joule heat which results in a large power loss and in a reduction in the antenna gain.

TECHNICAL FIELD OF THE INVENTION

A primary object of the present invention is, therefore, to provide a microwave plane antenna which can restrain the reflection of signal energy at the terminating ends of the respective paired microstrip lines so as to prevent the power loss from occurring at the terminating ends and thus to achieve a high antenna gain and improved aperture efficiency.

According to the present invention, this object can be attained by providing a microwave plane antenna which comprises a plurality of pairs of cranked microstrip lines respectively having cranked portions staggered in each of the pairs, and a power supply circuit including a tournament connection of branched strip line conductors respectively connected to one end of each of the pairs of the microstrip lines, wherein an impedance-matched patch antenna means is provided to the other terminating end of the respective pairs of the microstrip lines.

Other objects and advantages of the present invention shall be made clear in the following description of the invention detailed with references to preferred embodiments shown in accompanying drawings.

Figure 2:
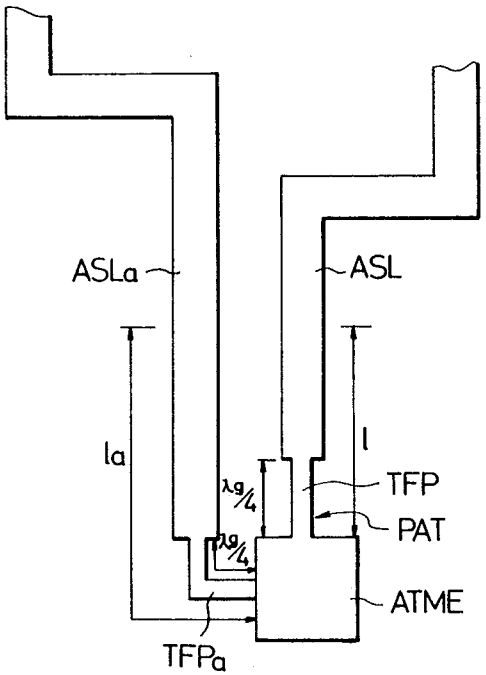
FIG. 2 is a fragmentary magnified plan view at the terminating end of the pair of microstrip lines in the plane antenna of FIG. 1.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 1:
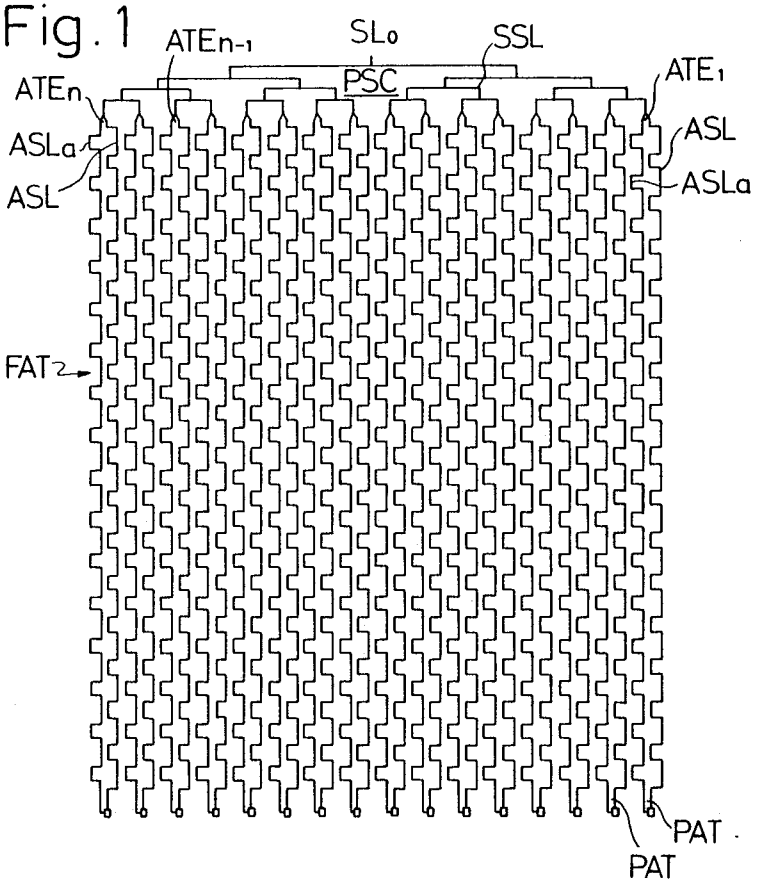
FIG. 1 is a schematic plan view in an embodiment of the plane antenna according to the present invention.

Referring to FIG. 1, there is shown a microwave plane antenna FAT of cranked microstrip lines in an embodiment of the present invention, in which a plurality of antenna elements $ATE_1$ to $ATE_n$ are arranged substantially in parallel rows. Each of the antenna elements $ATE_1$ to $ATE_n$ comprises a pair of microstrip lines ASL and ASLa of a conductor cranked cyclically repetitively, that is, bent into a plurality of successively connected U-shaped sections, and the pair of the microstrip lines ASL and ASLa are so arranged as to have cranked portions in each line respectively staggered with respect to those of the other line, so that a spatial phase difference will be provided for restraining the grating lobe of the radiation beam. Thus, the two conductors in each antenna element alternately approach and separate from each other. As a result, there can be provided a travelling wave antenna of single dimensional array which has a frequency characteristic and directivity determined by the manner in which the strip lines are cranked, i.e., cranking cycle of the microstrip lines ASL and ASLa. These antenna elements are provided on one surface of an insulating substrate (not shown) having over the other surface an earthing conductor.

The antenna elements $ATE_1$ to $ATE_n$ are connected at their one end to a power supply circuit PSC which comprises strip conductors lines SSL branched from a main power supply end $SL_o$ in a tournament or corporate-feed connection to the respective antenna elements at their one end, so that the travelling wave current can be supplied through this power supply circuit PSC parallelly to the respective antenna elements $ATE_1$ to $ATE_n$ at the same amplitude and phase.

Referring also to FIG. 2, the antenna elements $ATE_1$ to $ATE_n$ are respectively provided at the other terminating end with a patch antenna means PAT matched in the impedance with the paired microstrip lines ASL and ASLa and connected to these lines specifically at their portions approaching each other in the direction transversing the longitudinal direction of the microstrip lines. The patch antenna means PAT comprises a patch antenna member ATME and impedance transformer parts TFP and TFPa, and the member ATME which is of a substantially square-shaped conductor is connected to the paired microstrip lines ASL and ASLa through each of the transformer parts TFP and TFPa formed to be of ¼ wavelength. In an event where the microstrip lines ASL and ASLa have a line impedance $Z_1$ to 50Ω, then an input impedance $Z_2$ of the patch antenna member ATME is set to be 200Ω and a line impedance $Z_3$ of the transformer parts TFP and TFPa is to be 100Ω, that is, they are set to satisfy a relationship $Z_3^2=Z_1 \cdot Z_2$ for matching the impedance. Further, when each of the impedance transformer parts TFP and TFPa is set to be of a length of ½ wavelength, that is, $\lambda_g/4$ when the line wavelength is $\lambda_g$, in which case the line wavelength $\lambda_g$ is expressed by $\lambda_g=\eta \cdot \lambda_o$, where $\lambda_o$ is a spatial wavelength and $\eta$ is a wavelength contracting rate. Also, the line wavelength $\lambda_g$ is so set that signals respectively radiated from the microstrip lines ASL and ASLa and from the patch antenna means PAT will be in the same phase in the main beam direction of the plane antenna FAT and will be superposed on each other. In the illustrated embodiment, in particular, the terminating end parts of the microstrip lines ASL and ASLa are so set as to satisfy an equation $1a=1+\lambda_g/4$ upon reception of the circular polarized waves, where 1 and 1a are lengths along the lines ASL and ASLa from the patch antenna member ATME to a point of a predetermined same phase in the longitudinal direction of the antenna element, i.e., the lengths of phase adjusting lines.

With the arrangement as mentioned above, the patch antenna means PAT functions as a resonant circuit impedance-matched with the antenna element, so that no signal reflection nor undesirable signal radiation will take place. In other words, the signal energy which has reached the patch antenna means PAT will be all radiated therefrom and, accordingly, the signal energy which has been heretofore consumed at the termination resistors to cause the large power loss can be effectively utilized as the radiation energy, whereby the plane antenna FAT as a whole can be made high in the gain and aperture efficiency.

Figure 4:
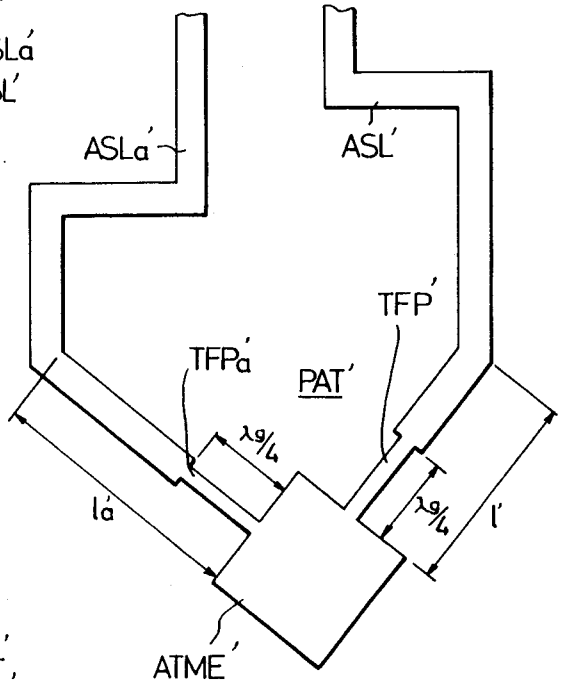
FIG. 4 is a fragmentary magnified plan view at the terminating end of a pair of the microstrip lines in the plane antenna of FIG. 3.
Figure 3:
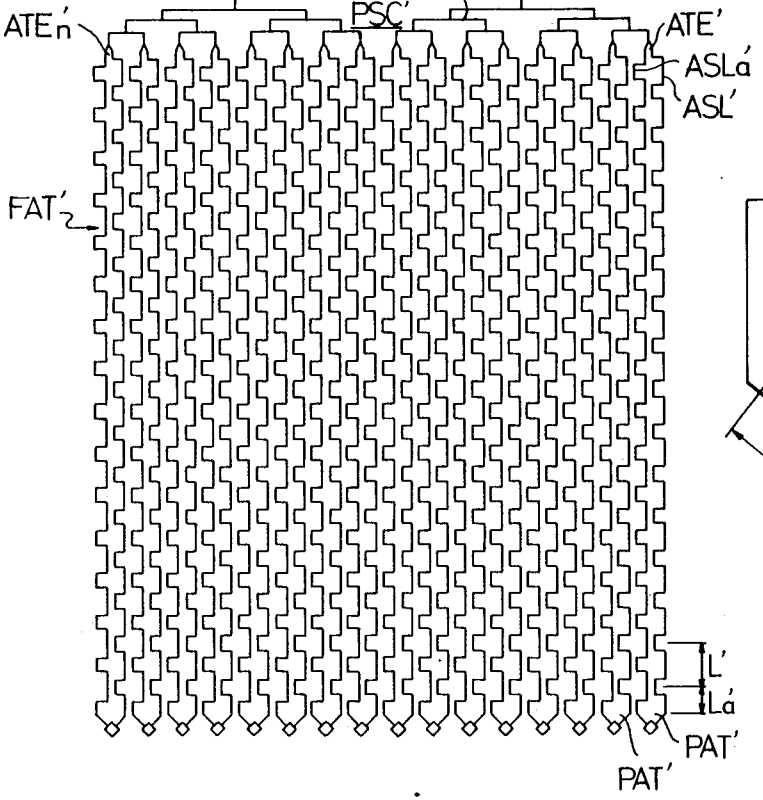
FIG. 3 is a schematic plan view in another embodiment of the plane antenna according to the present invention.

Referring next to FIGS. 3 and 4, there is shown a microwave plane antenna FAT' in another embodiment of the present invention, in which a patch antenna means PAT' is connected to the terminating end of the paired microstrip lines ASL' and ASLa' specifically at their portions separating from each other, in contrast to the patch antenna means PAT connected to the microstrip lines ASL and ASLa at their approaching portions in the foregoing embodiment of FIGS. 1 and 2. In the present instance, therefore, the microstrip lines ASL' and ASLa' are made to extend obliquely from their separated points convergently to a patch antenna member ATME' of the patch antenna means PAT', so as to define such lengths 1' and 1a' of the phase adjusting lines including impedance transformer parts TFP' and TFPa' that are set to safisfy the relationship $1a'=1'+\lambda_g/4$. Further, when the cranking cycle or distance between adjacent ones of the cranked portions in the respective microstrip lines ASL' and ASLa' is made L', a distance from the center of the last stage cranked portion in one (ASL') of the lines to the phase adjusting line at the terminating end part of the line ASL' is set to be L'/2, so as to optimize the impedance matching between the lines ASL' and ASLa' and the patch antenna means PAT' for achieving the high antenna gain. Other arrangement and operation of the plane antenna FAT' of FIGS. 3 and 4 are substantially the same as those of the plane antenna FAT of FIGS. 1 and 2.

While the present invention has been referred to as applied to the microwave plane antennas for use in receiving the circularly polarized waves, it should be appreciated that the invention is not limited to such application referred to, but can be commonly applied, for example, to plane antennas for receiving linearly polarized waves with any required design modification possible within the technical idea of the invention.

What is claimed as our invention is:

1. A microwave planar antenna, comprising:

a plurality of antenna elements, wherein each antenna element comprises two microstrip conductors, each conductor having first and second ends and being bent into a plurality of successively connected U-shaped sections, the two conductors being disposed in parallel with mutually staggered U-shaped sections, whereby the two microstrip conductors alternately approach and separate from each other;

means for supplying power to the plurality of antenna elements, wherein the power supply means is a corporate-feed network coupled to the first ends of the microstrip conductors in the plurality of antenna elements; and a plurality of patch antenna means for radiating power reaching the second ends of the microstrip conductors, wherein each patch antenna means couples the second ends of two microstrip conductors which comprise each antenna element, each patch antenna means is impedance-matched to the antenna element in which it couples the second ends of the two conductors, and each patch antenna means radiates as an antenna which is phase-matched to that antenna element.

2. A microwave planar antenna according to claim 1, wherein each of said plurality of patch antenna means comprises an antenna member and a pair of phase adjusting strip conductor lines, wherein the antenna member is made of an electric conductor, each phase adjusting strip conductor line includes an impedance transformer part and connects one of the second ends of the two microstrip conductors of an antenna element to the antenna member.

3. A microwave planar antenna according to claim 2, wherein said of said plurality of patch antenna means is connected to the second ends of the two microstrip conductors of each antenna element where said two microstrip conductors approach each other.

4. A microwave planar antenna according to claim 2, wherein each of said plurality of patch antenna means is connected to the second ends of the two microstrip conductors of each element where said two microstrip conductors separate from each other.

5. A microwave planar antenna according to claim 2, wherein said impedance transformer parts of the pairs of phase adjusting strip conductor lines are of a length $\lambda_g/4$ when a line wavelength is $\lambda_g$, and one of each pair of phase adjusting lines has a length which is a sum of $\lambda_g$ and a length of the other phase adjusting line.

6. A microwave planar antenna according to claim 2, wherein each antenna element has an impedance $Z_1$, each antenna member has an impedance $Z_2$, each impedance transformer part has an impedance $Z_3$, the impedances being related according to a relationship $Z^2{}_3 = Z_1 Z_2$.

* * * * *